US010494871B2

(12) United States Patent
Jain et al.

(10) Patent No.: US 10,494,871 B2
(45) Date of Patent: Dec. 3, 2019

(54) MODELING AND SIMULATION OF DRILL STRINGS WITH ADAPTIVE SYSTEMS

(71) Applicants: Jayesh R. Jain, The Woodlands, TX (US); Benjamin Baxter, Houston, TX (US); Chaitanya Vempati, Conroe, TX (US); Volker Peters, Wienhausen (DE); Holger Stibbe, Humble, TX (US)

(72) Inventors: Jayesh R. Jain, The Woodlands, TX (US); Benjamin Baxter, Houston, TX (US); Chaitanya Vempati, Conroe, TX (US); Volker Peters, Wienhausen (DE); Holger Stibbe, Humble, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 1136 days.

(21) Appl. No.: 14/516,203

(22) Filed: Oct. 16, 2014

(65) Prior Publication Data

US 2016/0110481 A1 Apr. 21, 2016

(51) Int. Cl.
*E21B 10/00* (2006.01)

(52) U.S. Cl.
CPC ..... *E21B 10/00* (2013.01)

(58) Field of Classification Search
None
See application file for complete search history.

(56) References Cited

U.S. PATENT DOCUMENTS 6,209,664 B1 4/2001 Amaudric Du Chaffaut
6,484,822 B2 11/2002 Watson et al.
6,484,825 B2 11/2002 Watson et al.
6,732,817 B2 5/2004 Dewey et al.
6,880,650 B2 4/2005 Hoffmaster et al.
6,971,459 B2 12/2005 Raney
7,201,237 B2 4/2007 Raney
7,314,099 B2 1/2008 Dewey et al.
(Continued)

FOREIGN PATENT DOCUMENTS

WO 2016187372 A1 11/2016
WO 2017044763 A1 3/2017
(Continued)

OTHER PUBLICATIONS

Landet, Ingar Skyberg, Alexey Pavlov, and Ole Morten Aamo. "Modeling and control of heave-induced pressure fluctuations in managed pressure drilling." IEEE Transactions on Control Systems Technology 21.4 (2013): 1340-1351. (Year: 2013).*
(Continued)

*Primary Examiner* — Bijan Mapar
(74) *Attorney, Agent, or Firm* — Cantor Colburn LLP

(57) ABSTRACT

A method and system of predicting behavior of a drill bit is disclosed, including generating a mathematical representation of a characteristic of at least one of a plurality of components of a drill bit, the plurality of components including at least one moveable cutter; at least one moveable rubbing element; and at least one moveable gage pad; simulating one or more operating conditions incident on the mathematical representation, and simulating an interaction between the plurality of components and an earth formation; and predicting physical responses of the mathematical representation to the one or more operating conditions.

21 Claims, 3 Drawing Sheets

(56) References Cited

U.S. PATENT DOCUMENTS

| | | | |
|---|---|---|---|
| 7,392,857 | B1 | 7/2008 | Hall et al. |
| 7,419,016 | B2 | 9/2008 | Hall et al. |
| 7,424,922 | B2 | 9/2008 | Hall et al. |
| 7,451,836 | B2 | 11/2008 | Hoffmaster et al. |
| 7,451,837 | B2 | 11/2008 | Hoffmaster et al. |
| 7,493,971 | B2 | 2/2009 | Nevlud et al. |
| 7,533,737 | B2 | 5/2009 | Hall et al. |
| 7,571,780 | B2 | 8/2009 | Hall et al. |
| 7,594,552 | B2 | 9/2009 | Radford et al. |
| 7,641,002 | B2 | 1/2010 | Hall et al. |
| 7,661,490 | B2 | 2/2010 | Raney |
| 7,721,823 | B2 | 5/2010 | Radford |
| 7,730,975 | B2 | 6/2010 | Hall et al. |
| 7,845,430 | B2 | 12/2010 | Johnson et al. |
| 7,849,939 | B2 | 12/2010 | Downton et al. |
| 7,882,905 | B2 | 2/2011 | Radford et al. |
| 7,971,661 | B2 | 7/2011 | Johnson et al. |
| 7,971,662 | B2 | 7/2011 | Beuershausen |
| 8,087,479 | B2 | 1/2012 | Kulkarni et al. |
| 8,205,686 | B2 | 6/2012 | Beuershausen |
| 8,205,689 | B2 | 6/2012 | Radford |
| 8,240,399 | B2 | 8/2012 | Kulkarni et al. |
| 8,281,882 | B2 | 10/2012 | Hall et al. |
| 8,302,703 | B2 | 11/2012 | Rolovic |
| 8,453,763 | B2 | 6/2013 | Radford et al. |
| 8,511,946 | B2 | 8/2013 | Woodruff et al. |
| 8,534,384 | B2 | 9/2013 | Beuershausen et al. |
| 8,746,368 | B2 | 6/2014 | Johnson et al. |
| 8,763,726 | B2 | 7/2014 | Johnson et al. |
| 8,813,871 | B2 | 8/2014 | Radford et al. |
| 8,950,517 | B2 | 2/2015 | Hall et al. |
| 8,960,329 | B2 | 2/2015 | Downton |
| 9,080,399 | B2 | 7/2015 | Oesterberg |
| 9,103,175 | B2 | 8/2015 | Schwefe |
| 9,140,074 | B2 | 9/2015 | Schwefe et al. |
| 9,181,756 | B2 | 11/2015 | Schwefe et al. |
| 9,187,960 | B2 | 11/2015 | Radford et al. |
| 9,255,449 | B2 | 2/2016 | Schwefe et al. |
| 9,255,450 | B2 | 2/2016 | Jain et al. |
| 9,267,329 | B2 | 2/2016 | Bilen |
| 9,279,293 | B2 | 3/2016 | Izbinski |
| 9,359,826 | B2 | 6/2016 | Do et al. |
| 9,399,892 | B2 | 7/2016 | Do et al. |
| 9,611,697 | B2 | 4/2017 | Radford et al. |
| 9,663,995 | B2 | 5/2017 | Jain |
| 9,677,344 | B2 | 6/2017 | Radford et al. |
| 9,708,859 | B2 | 7/2017 | Jain et al. |
| 9,759,014 | B2 | 9/2017 | Do et al. |
| 9,915,138 | B2 | 3/2018 | Schwefe et al. |
| 9,932,780 | B2 | 4/2018 | Spencer et al. |
| 9,970,239 | B2 | 5/2018 | Oesterberg |
| 10,000,977 | B2 | 6/2018 | Jain et al. |
| 10,001,005 | B2 | 6/2018 | Schwefe et al. |
| 10,041,305 | B2 | 8/2018 | Jain |
| 2005/0071120 | A1* | 3/2005 | Hutchinson ..... E21B 44/00 702/150 |
| 2009/0133931 | A1 | 5/2009 | Rolovic |
| 2010/0038141 | A1 | 2/2010 | Johnson et al. |
| 2011/0155473 | A1 | 6/2011 | Raney |
| 2011/0198126 | A1* | 8/2011 | Swietlik ..... E21B 17/07 175/55 |
| 2011/0272195 | A1* | 11/2011 | Trinh ..... E21B 44/005 175/50 |
| 2012/0152624 | A1* | 6/2012 | Chen ..... E21B 10/43 175/428 |
| 2013/0180784 | A1 | 7/2013 | Esko et al. |
| 2015/0247399 | A1* | 9/2015 | Doelalikar ..... E21B 47/06 175/48 |
| 2016/0138353 | A1 | 5/2016 | Ruttley et al. |
| 2016/0258224 | A1 | 9/2016 | Do et al. |
| 2017/0175455 | A1 | 6/2017 | Jain et al. |
| 2017/0234071 | A1 | 8/2017 | Spatz et al. |
| 2017/0335631 | A1 | 11/2017 | Eddison |
| 2017/0362898 | A1 | 12/2017 | Do et al. |
| 2018/0128060 | A1 | 5/2018 | Haugvaldstad |
| 2018/0179826 | A9 | 6/2018 | Jain et al. |

FOREIGN PATENT DOCUMENTS

| | | | |
|---|---|---|---|
| WO | 2017106605 | A1 | 6/2017 |
| WO | 2017132033 | A1 | 8/2017 |
| WO | 2017142815 | A1 | 8/2017 |

OTHER PUBLICATIONS

Zhou, L., et al. "Hydraulics of drilling with aerated muds under simulated borehole conditions." SPE/IADC Drilling Conference. Society of Petroleum Engineers, 2005. (Year: 2005).*

Pavković, Danijel, Joško Deur, and Anton Lisac. "A torque estimator-based control strategy for oil-well drill-string torsional vibrations active damping including an auto-tuning algorithm." Control engineering practice 19.8 (2011): 836-850. (Year: 2011).*

* cited by examiner

MODELING AND SIMULATION OF DRILL STRINGS WITH ADAPTIVE SYSTEMS

BACKGROUND INFORMATION

1. Field of the Disclosure

This disclosure relates generally to modeling the behavior of drill bits with adaptive systems and systems that utilize the same for drilling wellbores.

2. Background of the Art

Oil wells (also referred to as "wellbores" or "boreholes") are drilled with a drill string that includes a tubular member having a drilling assembly (also referred to as the "bottomhole assembly" or "BHA") at the bottom end of the tubular. The BHA typically includes devices and sensors that provide information relating to a variety of parameters relating to the drilling operations ("drilling parameters"), behavior of the BHA ("BHA parameters") and parameters relating to the formation surrounding the wellbore ("formation parameters"). While deployed in the borehole, the drill string may be subject to a variety of forces or loads. Because the drill string is in the borehole, the loads are unseen and can affect the dynamic behavior of the drill string. An immediate result of the unseen loads may be unknown. If the loads are detrimental, then continued operation of the drill string might cause damage or unreliable operation. Testing of the drill string may be performed to simulate the loads affecting the drill string and model drill bits. However, such modeling may not be able to predict the behavior of adaptive systems or optimize parameters for adaptive systems. Accordingly, it is desired to have a modeling and simulation system that generates a mathematical representation of adaptive systems for simulation and prediction of operating condition and physical responses.

The disclosure herein provides a method and a system to predict behavior of a drill bit with adaptive systems.

SUMMARY

In one aspect, method of predicting behavior of a drill bit is disclosed, including generating a mathematical representation of a characteristic of at least one of a plurality of components of a drill bit, the plurality of components including at least one moveable cutter; at least one moveable rubbing element; and at least one moveable gage pad; simulating one or more operating conditions incident on the mathematical representation, and simulating an interaction between the plurality of components and an earth formation; and predicting physical responses of the mathematical representation to the one or more operating conditions.

In another aspect, a non-transient computer program product for predicting behavior of a drill string assembly is disclosed, the computer program product including a tangible storage medium readable by a processing circuit and storing instructions for execution by the processing circuit for performing a method including generating a mathematical representation of a characteristic of at least one of a plurality of components of a drill bit, the plurality of components including at least one moveable cutter; at least one moveable rubbing element; and at least one moveable gage pad; simulating one or more operating conditions incident on the mathematical representation, and simulating an interaction between the plurality of components and an earth formation; and predicting physical responses of the mathematical representation to the one or more operating conditions.

In another aspect, a system for estimating a behavior of a drilling assembly during a drilling operation is disclosed, the system including a drilling assembly including at least an adaptive drill bit connected to a drill string, the drilling assembly configured to be disposed in a borehole; a plurality of sensors operatively associated with the drilling assembly; and a processor in communication with the plurality of sensors, the processor configured to: generate a mathematical representation of a characteristic of at least one of a plurality of components of a drill bit, the plurality of components including at least one moveable cutter; at least one moveable rubbing element; and at least one moveable gage pad; simulate one or more operating conditions incident on the mathematical representation, and simulating an interaction between the plurality of components and an earth formation; and predict physical responses of the mathematical representation to the one or more operating conditions.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DESCRIPTION OF THE EMBODIMENTS

Figure 1:
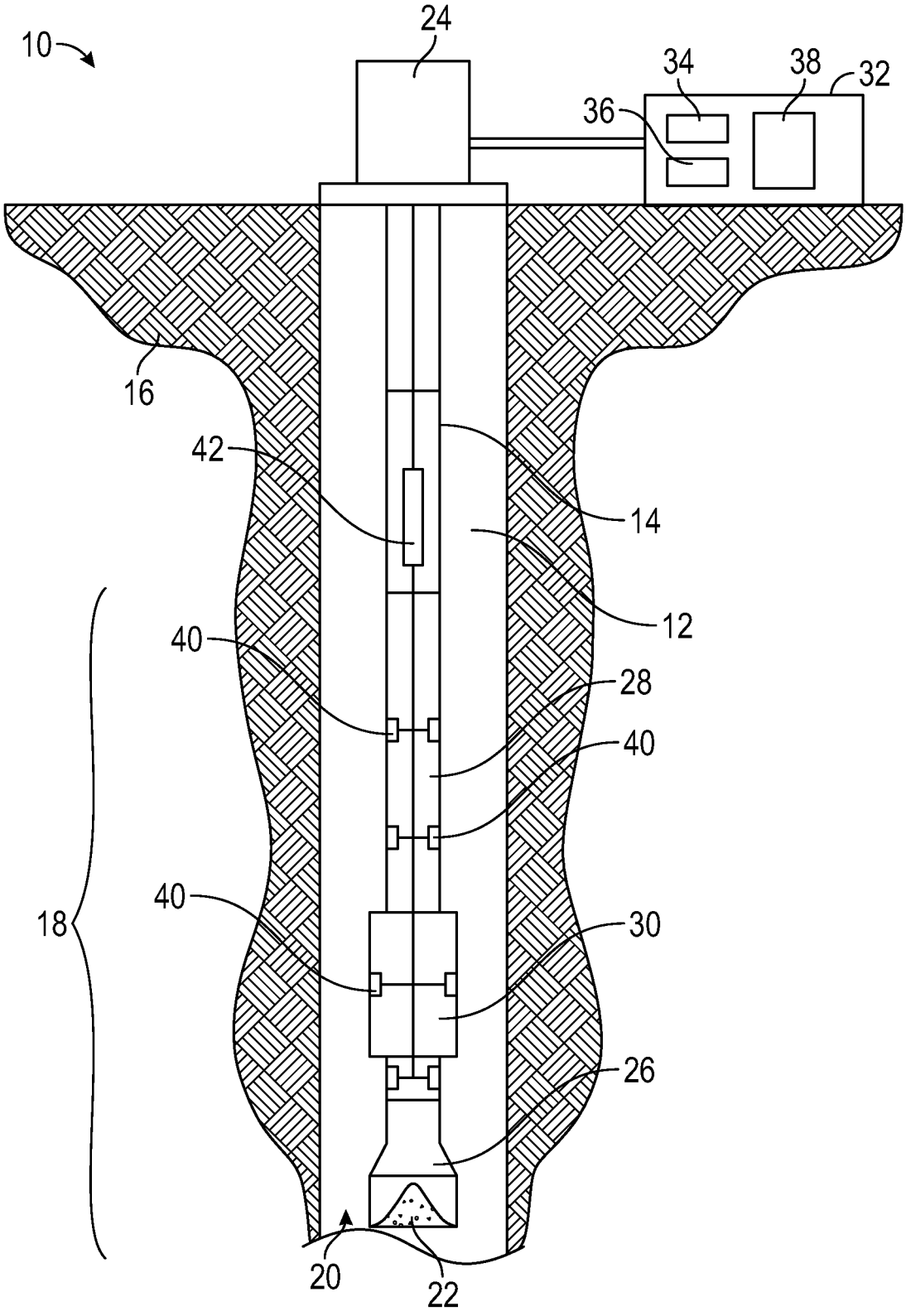
FIG. 1 is an exemplary embodiment of a drilling system including a drill string disposed in a borehole in an earth formation.

Referring to FIG. 1, an exemplary embodiment of a downhole drilling system 10 disposed in a borehole 12 is shown. A drill string 14 is disposed in the borehole 12, which penetrates at least one earth formation 16. Although the borehole 12 is shown in FIG. 1 to be of constant diameter, the borehole is not so limited. For example, the borehole 12 may be of varying diameter and/or direction (e.g., azimuth and inclination). The drill string 14 is made from, for example, a pipe or multiple pipe sections. The system 10 and/or the drill string 14 include a drilling assembly 18. Various measurement tools may also be incorporated into the system 10 to affect measurement regimes such as wireline measurement applications or logging-while-drilling (LWD) applications.

The drilling assembly 18, which may be configured as a bottomhole assembly (BHA), includes a drill bit 20 that is attached to the bottom end of the drill string 14 via various drilling assembly components. The drilling assembly 18 is configured to be conveyed into the borehole 12 from a drilling rig 24. The drilling assembly components includes various components that provide structural and operational support to the drill bit 20 and to drill bit cutters 22, as well as operably connect the drill bit 20 and the cutters 22 to the drill string 14. Exemplary drilling assembly components include a drill bit body 26 operably connected to the cutters 22, a drilling motor 28 (also referred to as a mud motor), and a stabilizer or reamer 30.

A processing unit 32 is connected in operable communication with the drilling assembly 18 and may be located, for example, at a surface location, a subsea location and/or a surface location on a marine well platform or a marine craft. The processing unit 32 may also be incorporated with the drill string 14 or the drilling assembly 18, or otherwise disposed downhole as desired. The processing unit 32 may be configured to perform functions such as controlling the drilling assembly 18, transmitting and receiving data, processing measurement data, monitoring the drilling assembly 18, and performing simulations of the drilling assembly 18 using mathematical models. The processing unit 32, in one embodiment, includes a processor 34, a data storage device (or a computer-readable medium) 36 for storing, data, models and/or computer programs or software 38.

In one embodiment, the drill bit 20 and/or drilling assembly 18 includes one or more sensors 40 and related circuitry for estimating one or more parameters relating to the drilling assembly 18. For example, a distributed sensor system (DSS) is disposed at the drilling assembly 18 and includes a plurality of sensors 40. The sensors 40 perform measurements associated with the dynamic motion of the drilling assembly 18 and/or the drill string 14 or a static parameter associated therewith, and may also be configured to measure environmental parameters such as temperature and pressure. Non-limiting example of measurements performed by the sensors include accelerations, velocities, distances, angles, forces, moments, and pressures. As one example of distribution of sensors, the sensors may be distributed throughout a drill string and tool (such as a drill bit) at the distal end of the drill string 14. In one embodiment, the sensors 40 are coupled to a downhole electronics unit 42, which may receive data from the sensors 40 and transmit the data to a processing system such as the processing unit 32. Various techniques may be used to transmit the data to the processing unit 32, such as mud pulse, electromagnetic, acoustic telemetry, or wired pipe.

As used herein, "dynamic motion" relates to a change in steady-state motion of the drill string. Dynamic motion can include vibrations and resonances. The term "static parameter" relates to a parameter associated with a drill string. The static parameter is generally a physical condition experienced by the drill string. Non-limiting examples of the static parameter include a displacement, a force or load, a moment (e.g., torque or bending moment), or a pressure.

Figure 2:
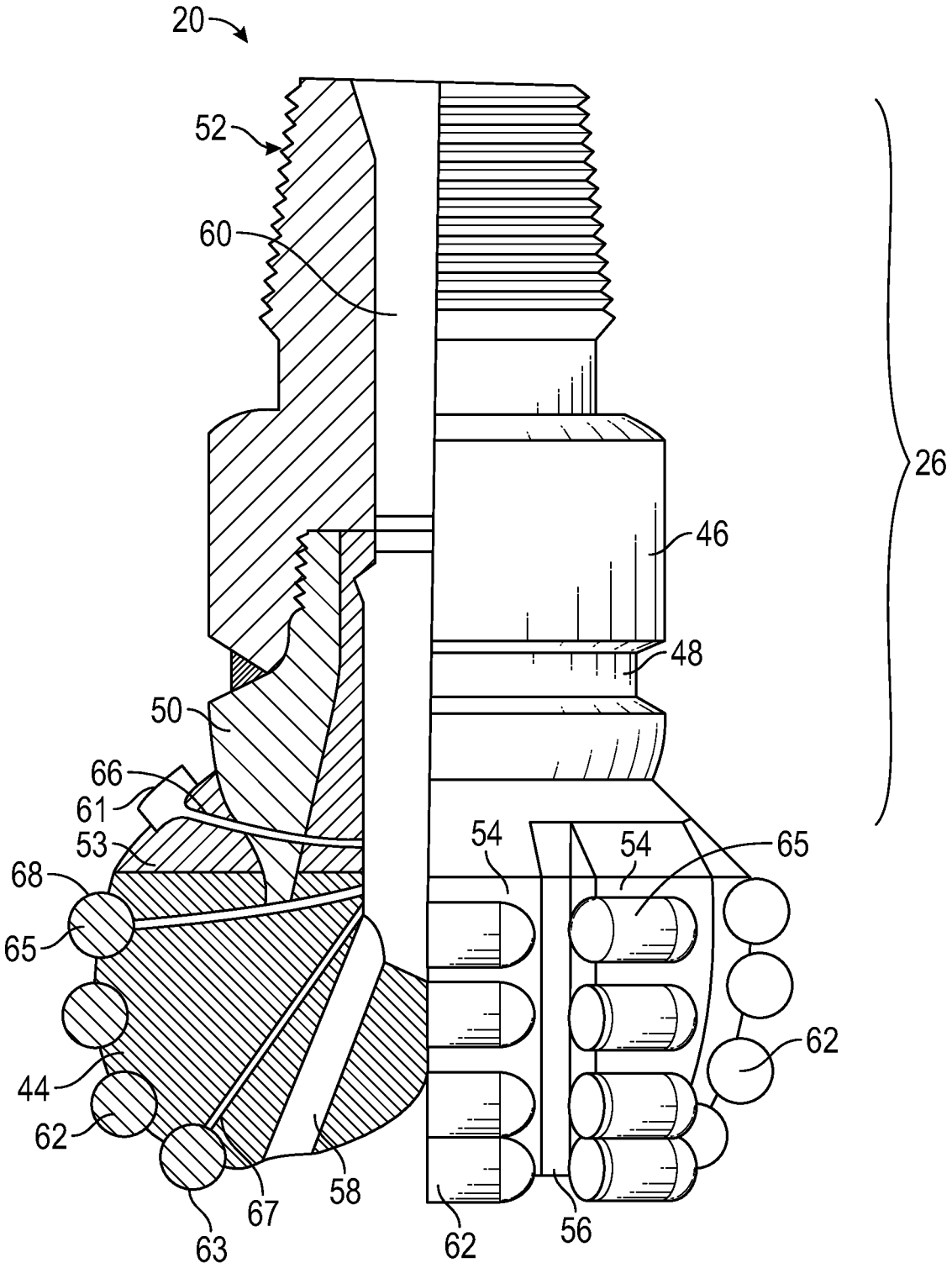
FIG. 2 is a perspective view of an exemplary embodiment of a drill bit of the drilling system of FIG. 1.

An exemplary embodiment of an earth-boring rotary drill bit 20 is shown in FIG. 2. In an exemplary embodiment, drill bit 20 includes at least one adaptive subsystem, including, but not limited to adaptive (or movable and self-adjustable) cutters 63, ovoids 65, and gage pads 61. In certain embodiments, adaptive systems include other moveable rubbing elements. The drill bit 20 includes a crown 44 and the bit body 26. The bit body 26 may include various structural components, such as a shank 46 secured to the crown 44 by a weld 48, a steel blank 50, and a connection mechanism such as a threaded connection 52 for operably connecting the drill bit 20 to the drillstring or other components such as the mud motor 28 or reamer 30. Other components include a bit gage 53 disposed adjacent to the crown 44. The bit gage 53 may include various components including gage pads and gage trimmers. In an exemplary embodiment, moveable or adaptive gage pads 61 are utilized to control the stability and vibrations of the drill bit 20. Adaptive gage pads 61 may be used with control system 66 to control the extension and retract of adaptive gage pads 61 for desired performance and reduced friction. Control systems 66 may include self-adjusting actuators, electrically controlled actuators, mechanically controlled actuators, generally passive actuators, generally active actuators and hydraulic actuators. Further examples of components include other components that rub or contact the borehole wall or formation material in general, such as Tracblocks, ovoids, wear knots and others. In an exemplary embodiment, moveable or adaptive rubbing components, such as adaptive ovoids 65 are utilized to control the stability, vibrations, wear, and depth of cut of the drill bit 20. Moveable ovoids 65 may be used with control system 68 to control the extension and retract of adaptive ovoids 65 for desired performance and reduced friction. Control systems 68 may include self-adjusting actuators, electrically controlled actuators, mechanically controlled actuators, generally passive actuators, generally active actuators and hydraulic actuators.

The bit body 26 includes wings or blades 54, which are separated by external channels or conduits also known as junk slots 56. Internal fluid passageways 58 may be included that extend between an exterior of the crown 44 and a longitudinal bore 60 that extends through the bit body 26. A plurality of cutters 62 (e.g., PDC cutters) are disposed on the crown 44. In an exemplary embodiment, moveable or adaptive cutters 63 are utilized to control the depth of cut and other properties of the drill bit 20. Adaptive cutters 63 may be used with control system 67 to control the extension and retract of adaptive cutters 63 for desired performance and reduced friction. Control systems 67 may include self-adjusting actuators, electrically controlled actuators, mechanically controlled actuators, generally passive actuators, generally active actuators and hydraulic actuators.

Figure 3:
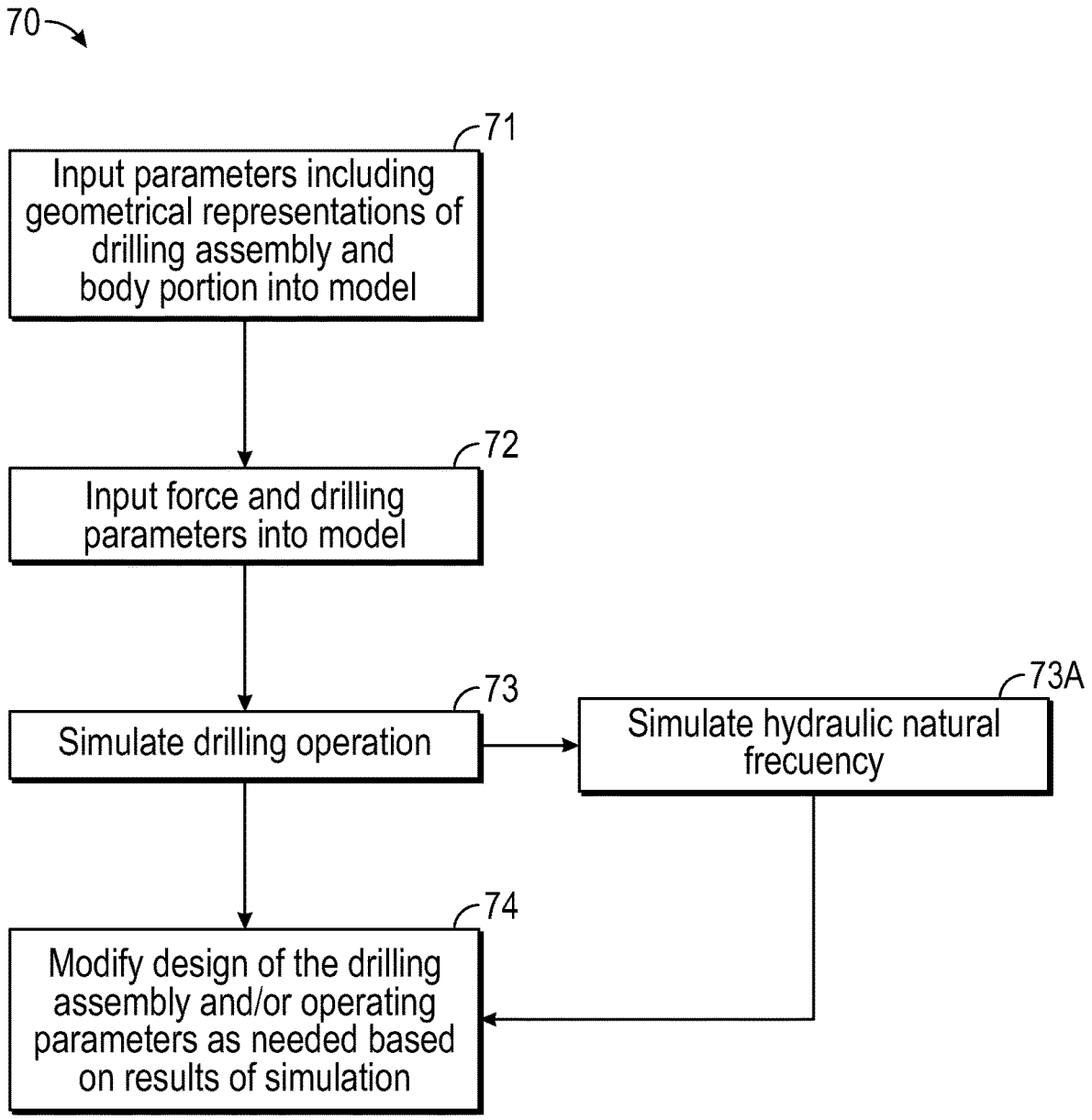
FIG. 3 is a flow chart representing an embodiment of a method of predicting and/or simulating behavior of a drilling assembly using a model of the drilling assembly.

Referring to FIG. 3, a method 70 of predicting drill string assembly parameters and/or behavior is described. The method may be executed by a computer processing system (e.g., the processing unit 32) via programs or software for generating a drill string assembly dynamics model, which may be used to investigate or predict the performance and behavior of the assembly under selected downhole and drilling conditions. Exemplary components of such a computer processing system include, without limitation, at least one processor, storage, memory, input devices, output devices and the like. At least portions of the method 70 may be performed using previously generated and stored data, or may be performed using real-time data generated during a subterranean operation or experimental operation of drilling components such as the drilling assembly 18. In certain embodiments, method 70 is performed for pre well planning or post well analysis. The method 70 includes one or more stages 71-74. In one embodiment, the method 70 includes the execution of all of stages 71-74 in the order described. However, certain stages may be omitted, stages may be added, or the order of the stages changed.

In the first stage 71, input parameters including geometric data (e.g., layout, orientation, size and shape), adaptive system initial states, and adaptive control system responses describing the drilling assembly 18 are selected to be input into a mathematical model of the drilling assembly 18. The model uses the geometric data and adaptive control system data to generate representations of the geometry of one or more components of the drilling assembly 18 and interactions between drilling system components (e.g., bits, motors, thrusters, stabilizers, wellbore, drilling fluid), as well as interactions between the drilling assembly 28 and the borehole wall borehole fluid and/or formation materials, during drilling operations. The model is provided to allow users to simulate conditions and component interactions that are encountered during a drilling operation.

An exemplary simulation model is generated using the finite element method. In one embodiment, a plurality of node elements are generated from the geometric data that correspond to the shape or geometry of different portions of the drilling assembly 18.

In one embodiment, the drillstring assembly is modeled as a three-dimensional model using finite elements such as geometrically nonlinear beam or mass elements. Nodes are assigned for various components of the drill string assembly. For example, nodes may be provided to simulate the geometrical shape and density of the drill bit, cutters and various components of the drilling assembly and/or the drill string. Such components include the various support structures provided to physically and operably support the drill bit cutters and/or connect the cutters to the drill string. Exemplary components that may make up elements of the model include the drill bit body 26, the shank 46, the connector 52, blades, 54, the steel blank 50, the gage 53, the mud motor 28, the reamer 30, adaptive gage pads 61 with respective control system 66, adaptive cutters 63 with respective control system 67, and adaptive ovoids 65 with respective control system 68. Other components include other rubbing elements, including adaptive rubbing elements, gage pads, gage trimmers, Tracblocks, ovoids, wear knots and others. In an exemplary embodiment, the states of such adaptive systems are monitored and incremented during simulation. In one embodiment, the model includes (e.g., as model elements) any components of the drilling assembly (including crown components and body components) that rub against the borehole wall or casing, or otherwise come into contact with formation material. In one embodiment, the model includes any surface or geometry on the bit body that is not comprised of cutters such as super-abrasive cutters. In one embodiment, the model includes a plurality of nodes corresponding to a configuration of the bit body 26. Nodes may be included for the drill string portion, the mud motor 28 and optionally one or more reamers 30.

In addition, the model may include input parameters relating to the formation and/or the borehole. For example, the diameter and direction of the borehole (e.g., azimuth and inclination) as well as changes in the borehole can be input into the model. Such borehole parameters can be taken from measurements taken during (e.g., real time) or after drilling, such as real-time caliper measurements. Such parameters may also be an output of the model and predict the borehole quality (e.g., hole spiraling). The prediction may include new azimuth and inclination, build rate etc.

This embodiment of the model provides superior accuracy of predictions by modeling the bit body structure(s) between the drill bit and the drill string, in addition to the drill string and the bit (e.g., crown and cutters). By modeling the structural support of the drill bit (the bit body), additional information regarding vibration, deformation and other behaviors may be derived that had been previously ignored. In addition, friction between components of the drilling assembly and the formation can be modeled, including adaptive components, and different friction models can be applied to determine friction characteristics, such as Coulomb friction or Stribeck type friction characteristics. The model can be used to predict behaviors of adaptive systems 61, 63, and 65, and adaptive rubbing surfaces as well as conventional rubbing surfaces so that such rubbing surfaces can be designed to improve drilling operations, e.g., to improve tool face control or steerability and reduce rubbing surface exposure to mitigate stick-slip. Also, additional frictional-damping can be designed to provide lateral stability. These and other benefits of rubbing surfaces can be optimized using the computer model.

In one embodiment, each node in a finite element model is given six degrees of freedom (three translations, three rotations), and is confined within an area representing the borehole 12 using for example a penalty function approach. Equations of motion can be used in conjunction with these degrees of freedom and may be integrated using an implicit or explicit, variable or fixed time step procedure.

For example, deformations of each node generated to represent the drilling assembly 18 are measured by three nodal displacements and three rotations noted as follows:

Lateral displacements: $u_1$, $u_2$

Lateral rotations: $\theta_1$, $\theta_2$

Axial displacement: $u_3$,

Axial rotation: $\theta_3$

This formulation together with the geometrical nonlinearity enables the analysis of coupled lateral, axial and torsional vibrations in the frequency domain and the time domain, as well as the calculation of, e.g., buckling loads and post-buckling behavior.

In the second stage 72, various operational, drilling and force parameters are applied to the model to simulate a drilling operation. Systems of coupled, nonlinear equations of motion are used, which are integrated through time to obtain transient and steady state displacements, loads and stresses. Various input forces may be input such as weight-on-bit, drilling rotation speed, fluid pressure, mass imbalance forces, axial stresses, radial stresses, weights of various components, characteristics of adaptive systems, and structural parameters such as stiffness.

Other parameters that may be applied include parameters related to the interaction between the components of the model and the borehole environment, which includes a borehole wall, casing, borehole fluid and/or formation. Borehole fluid may include any type of fluid encountered in the borehole, such as drilling mud, steam, and fluids from the formation such as water, oil, gas and other hydrocarbons. Examples of such interaction parameters include rate of formation (e.g., rock) removal by components such as the cutters (adaptive or static) and the bit body, including variable rates from adaptive cutters. In certain embodiments, the displacement of adaptive systems are related to force parameters in non linear equations, allowing the displacement of adaptive systems (such as moveable cutters, moveable rubbing members, and moveable gage pads) to be related to resultant forces and allowing forces exerted on adaptive systems to be related to the displacement of adaptive systems. Including individual removal rates for different parameters provides additional detail, as the bit body may be responsible for some removal, and this removal can be modeled at a different rate than the cutters. Other interaction parameters includes forces experienced on the drilling assembly and/or drill string due to push-back from contact with the borehole wall, such as frictional forces experienced by different components of the model due to contact with the borehole wall, including adaptive gage pads and adaptive ovoids, as well as other adaptive rubbing members, which generates additional torque on the drilling assembly. Other parameters include effects of interaction with the borehole wall on the drilling operation and the transient effects of the control systems for adaptive systems. For example, the rotation rate (e.g., RPM) or the rate of penetration can be limited due to contact between components of the drilling assembly and the borehole wall. The models are not limited to predicting frictional forces. For example, the interaction between the drilling assembly (e.g., rubbing surfaces of the body and crown) is not limited to modeling frictional forces. Any forces resulting from contact with rock and other formation materials can be modeled.

In one embodiment, using the degrees of motion and input force values, an exemplary nonlinear system of differential equations is derived:

$$M\ddot{u}+F_F(u,\dot{u})+F_W(u,\dot{u})+F_G(u)=R+F_E(u,\dot{u},t) \quad (3)$$

with u: displacements/rotations of nodes

M: mass matrix $F_F$: distributed forces from the mud $F_W$: wall contact force $F_G$: nonlinear elastic forces R: static forces (weight, buoyancy, WOB . . . )

$F_E$: excitation forces (mass imbalances, . . . )

The nodes and forces described herein are exemplary and not intended to be limiting. Any suitable forces desired to be modeled may be used.

The above equations are solved in the time domain to evaluate the dynamic response of the structures modeled by the nodes. In one embodiment, the equations are solved by a Newmark integration scheme. Other methods for solving the equations may be used, including but not limited to the finite difference method. In one embodiment, the equations may be solved in the frequency domain, for example to estimate lateral dynamics or provide details for static cases or steady state cases.

In the third stage 73, the simulated behavior of the modeled drill string assembly, generated from outputs of the model, is estimated. This behavior may be referred to as downhole dynamic events and may be classified as having one or more modes, such as axial events (e.g., bit bounce, Kelly bounce), lateral events, torsional events (e.g., Stick-slip) and whirl events.

Other behaviors include predictions of changes in the borehole (e.g., diameter, azimuth and inclination), as well as changes in borehole quality (e.g., spiraling, over gage). The prediction may include outputs such as new azimuth and inclination, build rate and others.

The simulated behavior includes physical responses including (but not limited to) dynamic behavior of the drillstring/bit assembly, the dynamic and transient behavior of the adaptive systems and the respective control systems, the static solution of the drillstring/bit assembly, the build-up rate of the drillstring/bit assembly in a given formation due to the dynamic behavior of the drillstring/bit assembly, and the build-up rate of the drillstring/bit assembly in a given formation due to the static solution of the drillstring/bit assembly.

In the stage 73A, for embodiments utilizing hydraulic systems, the hydraulic natural frequency of a system is simulated and estimated. In an exemplary embodiment, adaptive control systems, such as the control systems 66, 67, 68 utilized to control adaptive gage pads 61, adaptive cutters 63, and adaptive ovoids 65 utilize hydraulic control systems. These hydraulic control systems have one or more natural frequencies due to the mass of the system and the compliance of the fluid. Undesirable performance and failures can be avoided if the natural frequencies and resonances are avoided. In an exemplary embodiment, a hydraulic natural frequency is calculated based on factors, such as the effective mass of the adaptive elements, effective dampening, and effective compliance of the hydraulic system. In certain embodiments, these factors can be described by the bulk modulus of the hydraulic fluid with dependence on temperature and pressure, trapped air in a hydraulic system, and mechanical compliance of the housing and passages. In an exemplary embodiment, the natural frequency is contingent on the current position of the adaptive element and any related pistons. In certain embodiments, potential excitation sources, such as bit whirl, pump strokes, and axial, torsional, and lateral resonance are used for resonance calculations. After such a natural frequency is determined, utilizing the methodology described above, design changes may be iteratively simulated to avoid excitation frequencies and to avoid resonance. In certain embodiments, methods of changing the natural frequency includes changing the effective mass or compliance of the system.

In stage 74, in one embodiment, the input parameters are modified as necessary to change the design of the drill string (e.g., the drill bit, BHA and/or other drill string components) so that the simulated behavior is within selected limits. Such design changes may include shape or diameter of the bit body or other components of the drilling assembly, modification or inclusion of stabilizing structures on the bit body or drill string portion. Other design changes may include changing the weight, diameter, thickness and/or stiffness of tubular elements, and changing the side and/or front exposure of the cutters. In an exemplary embodiment, variables relating to adaptive systems, such as extension and retraction of adaptive components, such as gage pads, ovoids, cutters, and rubbing elements can be changed. Other parameters that can be changed include operating parameters such as rotational speed and weight on bit. After these parameters are changed, the behavior is again simulated to determine whether improvement and/or stability increase. Such design changes can be performed on the model and the model simulated in an iterative fashion to optimize the design of the drill string and/or the operating parameters, as well as optimizing designs of experiments and simulations (e.g., monte carlo simulation).

In one embodiment, the mathematical model is validated with measurements of motion or static parameters taken during operation of a drilling assembly. For example, during a drilling operation, a dynamic motion or static parameter is estimated via the model for a location at which a measurement is performed. The dynamic motion or static parameter is then compared to the measurement. If the difference between the estimated dynamic motion or the static parameter and the measurement is within a certain tolerance, then the mathematical model is validated. Loads such as forces or moments imposed on the drill string in the mathematical model can also be validated this way. The measurements may be updated on a continuous or periodic basis while the drilling assembly is operating. Sensors distributed at the drill string (i.e., operatively associated with the drill string), such as the sensors 40, may be used to provide the measurements of dynamic motion or the static parameter. Validation of the model can be performed after drilling or in real time during a drilling operation.

In another embodiment, the model may be used to simulate drill string assembly behavior prior to performing a drilling operation, in real time during a drilling operation and/or after a drilling operation is completed. For example, real time dynamic events may be measured by the sensors and transmitted to the processor, which applies these measurements to the model to evaluate the performance of the drill string assembly. The results of this application may be used to change drilling parameters or otherwise control the drilling operation via, for example, the processing unit 32. In one embodiment, generation of data or measurements in "real-time" is taken to mean generation of the data at a rate that is useful or adequate for providing control functions or making decisions during or concurrent with processes such drilling operations. Accordingly, it should be recognized that "real-time" is to be taken in context, and does not necessarily indicate the instantaneous determination of data, or make any other suggestions about the temporal frequency of data collection and determination.

The systems and methods described herein provide various advantages over prior art techniques. For example, models of the drilling assembly can be generated and tested that include a more complete description of the drilling assembly than has been achieved by prior art techniques, which typically limit models to include a drill string and a bit (i.e., the crown and one or more cutters). The systems and methods described herein provide more complete models including the bit body and other body portions of the drilling assembly (e.g., a mud motor), which leads to more realistic models and more accurate simulation results.

Generally, some of the teachings herein are reduced to an algorithm that is stored on machine-readable media. The algorithm is implemented by the computer processing system and provides operators with desired output. In an exemplary embodiment, the desired output is transmitted to operators at a surface or otherwise remote location to provide operation relevant data.

In support of the teachings herein, various analysis components may be used, including digital and/or analog systems. The digital and/or analog systems may be included, for example, in the downhole electronics unit 42 or the processing unit 32. The systems may include components such as a processor, analog to digital converter, digital to analog converter, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, motive force (such as a translational force, propulsional force, or a rotational force), digital signal processor, analog signal processor, sensor, magnet, antenna, transmitter, receiver, transceiver, controller, optical unit, electrical unit or electromechanical unit may be included in support of the various aspects discussed herein or in support of other functions beyond this disclosure.

Therefore in one aspect, method of predicting behavior of a drill bit is disclosed, including generating a mathematical representation of a characteristic of at least one of a plurality of components of a drill bit, the plurality of components including at least one moveable cutter; at least one moveable rubbing element; and at least one moveable gage pad; simulating one or more operating conditions incident on the mathematical representation, and simulating an interaction between the plurality of components and an earth formation; and predicting physical responses of the mathematical representation to the one or more operating conditions. In certain embodiments, the mathematical representation of the characteristic includes at least one control system of the plurality of components. In certain embodiments, the at least one control system of the plurality of components is a group consisting of: a passive control system and an active control system. In certain embodiments, the at least one control system of the plurality of components is a group consisting of: an electrical control system, a mechanical control system, and a hydraulic control system. In certain embodiments, the control system is the hydraulic control system having a natural resonance frequency. In certain embodiments the method further including modeling operation of the mathematical representation to avoid the natural resonance frequency. In certain embodiments, the mathematical representation of the characteristic includes a bulk modulus of a hydraulic fluid, a temperature of the hydraulic fluid, a pressure of the hydraulic fluid, a trapped air content, a mechanical compliance of a housing, and a mechanical compliance of a passage. In certain embodiments, the mathematical representation of the characteristic includes a layout of the plurality of components and a geometry of the plurality of components. In certain embodiments, the mathematical representation of the characteristic includes at least one material property of the plurality of components.

In another aspect, a non-transient computer program product for predicting behavior of a drill string assembly is disclosed, the computer program product including a tangible storage medium readable by a processing circuit and storing instructions for execution by the processing circuit for performing a method including generating a mathematical representation of a characteristic of at least one of a plurality of components of a drill bit, the plurality of components including at least one moveable cutter; at least one moveable rubbing element; and at least one moveable gage pad; simulating one or more operating conditions incident on the mathematical representation, and simulating an interaction between the plurality of components and an earth formation; and predicting physical responses of the mathematical representation to the one or more operating conditions. In certain embodiments, the at least one control system of the plurality of components is a group consisting of: an electrical control system, a mechanical control system, and a hydraulic control system. In certain embodiments, the control system is the hydraulic control system having a natural resonance frequency. In certain embodiments, the computer program product further including modeling operation of the mathematical representation to avoid the natural resonance frequency. In certain embodiments, the mathematical representation of the characteristic includes a bulk modulus of a hydraulic fluid, a temperature of the hydraulic fluid, a pressure of the hydraulic fluid, a trapped air content, a mechanical compliance of a housing, and a mechanical compliance of a passage. In certain embodiments, the mathematical representation of the characteristic includes a layout of the plurality of components and a geometry of the plurality of components.

In another aspect, a system for estimating a behavior of a drilling assembly during a drilling operation is disclosed, the system including a drilling assembly including at least an adaptive drill bit connected to a drill string, the drilling assembly configured to be disposed in a borehole; a plurality of sensors operatively associated with the drilling assembly; and a processor in communication with the plurality of sensors, the processor configured to: generate a mathematical representation of a characteristic of at least one of a plurality of components of a drill bit, the plurality of components including at least one moveable cutter; at least one moveable rubbing element; and at least one moveable gage pad; simulate one or more operating conditions incident on the mathematical representation, and simulating an interaction between the plurality of components and an earth formation; and predict physical responses of the mathematical representation to the one or more operating conditions. In certain embodiments, the control system is the hydraulic control system having a natural resonance frequency. In certain embodiments, the system further including modeling operation of the mathematical representation to avoid the natural resonance frequency. In certain embodiments, the mathematical representation of the characteristic includes a bulk modulus of a hydraulic fluid, a temperature of the hydraulic fluid, a pressure of the hydraulic fluid, a trapped air content, a mechanical compliance of a housing, and a mechanical compliance of a passage. In certain embodiments, the mathematical representation of the characteristic includes a layout of the plurality of components and a geometry of the plurality of components. In certain embodiments, the system further including that the physical responses of the mathematical representation to the one or more operating conditions are transmitted to an operator.

The invention claimed is:

1. A method of predicting behavior of a drill bit, comprising:

generating a mathematical representation of a characteristic of at least one of a plurality of components of a drill bit, the plurality of components including at least one moveable cutter, at least one moveable rubbing element, at least one moveable gage pad, and a hydraulic system for controlling the at least one moveable gage pad;

simulating one or more operating conditions incident on the mathematical representation, and simulating an interaction between the plurality of components and an earth formation;

determining a natural frequency of the hydraulic system based on a mass of the hydraulic system and a compliance of a fluid of the hydraulic system;

predicting physical responses of the mathematical representation to the one or more operating conditions at the natural frequency of the hydraulic system; and changing, during drilling, a configuration of the at least one of the plurality of components of the drill bit based on the predicted physical response to avoid excitation of the natural frequency of the hydraulic system.

2. The method of claim 1, wherein the mathematical representation of the characteristic includes at least one control system of the plurality of components.

3. The method of claim 2, wherein the at least one control system of the plurality of components is a group consisting of: a passive control system and an active control system.

4. The method of claim 2, wherein the at least one control system of the plurality of components is a group consisting of: an electrical control system, a mechanical control system, and a hydraulic control system.

5. The method of claim 4, wherein the control system is the hydraulic control system having a natural resonance frequency.

6. The method of claim 5, further comprising modeling operation of the mathematical representation to avoid the natural resonance frequency.

7. The method of claim 5, wherein the mathematical representation of the characteristic includes a bulk modulus of a hydraulic fluid, a temperature of the hydraulic fluid, a pressure of the hydraulic fluid, a trapped air content, a mechanical compliance of a housing, and a mechanical compliance of a passage.

8. The method of claim 1, wherein the mathematical representation of the characteristic includes a layout of the plurality of components and a geometry of the plurality of components.

9. The method of claim 1, wherein the mathematical representation of the characteristic includes at least one material property of the plurality of components.

10. A non-transient computer program product for predicting behavior of a drill string assembly, the computer program product including a non-transitory storage medium readable by a processing circuit and storing instructions for execution by the processing circuit for performing a method comprising:

generating a mathematical representation of a characteristic of at least one of a plurality of components of a drill bit, the plurality of components including at least one moveable cutter, at least one moveable rubbing element, at least one rubbing element, at least one moveable gage pad, and a hydraulic system for controlling the at least one moveable gage pad;

simulating one or more operating conditions incident on the mathematical representation, and simulating an interaction between the plurality of components and an earth formation;

determining a natural frequency of the hydraulic system based on a mass of the hydraulic system and a compliance of a fluid of the hydraulic system:

predicting physical responses of the mathematical representation to the one or more operating conditions at the natural frequency of the hydraulic system; and changing, during drilling, a configuration of the at least one of the plurality of components of the drill bit based on the predicted physical response to avoid excitation of the natural frequency of the hydraulic system.

11. The computer program product of claim 10, wherein the at least one control system of the plurality of components is a group consisting of: an electrical control system, a mechanical control system, and a hydraulic control system.

12. The computer program product of claim 11, wherein the control system is the hydraulic control system having a natural resonance frequency.

13. The computer program product of claim 12, further comprising modeling operation of the mathematical representation to avoid the natural resonance frequency.

14. The computer program product of claim 12, wherein the mathematical representation of the characteristic includes a bulk modulus of a hydraulic fluid, a temperature of the hydraulic fluid, a pressure of the hydraulic fluid, a trapped air content, a mechanical compliance of a housing, and a mechanical compliance of a passage.

15. The computer program product of claim 14, wherein the mathematical representation of the characteristic includes a layout of the plurality of components and a geometry of the plurality of components.

16. A system for estimating a behavior of a drilling assembly during a drilling operation, the system comprising:

a drilling assembly including at least an adaptive drill bit connected to a drill string, the drilling assembly configured to be disposed in a borehole;

a plurality of sensors operatively associated with the drilling assembly; and a processor in communication with the plurality of sensors, the processor configured to:

generate a mathematical representation of a characteristic of at least one of a plurality of components of a drill bit, the plurality of components including at least one moveable cutter, at least one moveable rubbing element, at least one rubbing element, at least one moveable gage pad, and a hydraulic system for controlling the at least one moveable gage pad;

simulate one or more operating conditions incident on the mathematical representation, and simulating an interaction between the plurality of components and an earth formation;

determine a natural frequency of the hydraulic system based on a mass of the hydraulic system and a compliance of a fluid of the hydraulic system;

predict physical responses of the mathematical representation to the one or more operating conditions to at the natural frequency of the hydraulic system; and change, during drilling, a configuration of the at least one of the plurality of components of the drill bit based on the predicted physical response.

17. The system of claim 16, further comprising a hydraulic control system having a natural resonance frequency.

18. The system of claim 17, further comprising modeling operation of the mathematical representation to avoid the natural resonance frequency.

19. The system of claim 17, wherein the mathematical representation of the characteristic includes a bulk modulus of a hydraulic fluid, a temperature of the hydraulic fluid, a pressure of the hydraulic fluid, a trapped air content, a mechanical compliance of a housing, and a mechanical compliance of a passage.

20. The system of claim 16, wherein the mathematical representation of the characteristic includes a layout of the plurality of components and a geometry of the plurality of components.

21. The system of claim 16, wherein the physical responses of the mathematical representation to the one or more operating conditions are transmitted to an operator.

* * * * *